US005465835A

United States Patent [19]

Schumacher et al.

[11] Patent Number: 5,465,835

[45] Date of Patent: Nov. 14, 1995

[54] BOTTLE CLOSURE CAP FOR TWO-COMPONENT PACKINGS

[75] Inventors: Clemens Schumacher, Sundern; Arthur Ziegler, Kirschroth, both of Germany

[73] Assignee: Robert Finke GmbH & Co. KG, Finnentrop, Germany

[21] Appl. No.: 259,269

[22] Filed: Jun. 13, 1994

Related U.S. Application Data

[63] Continuation of Ser. No. 922,529, Jul. 29, 1992, abandoned, which is a continuation of Ser. No. 906,303, Jun. 29, 1992, abandoned.

[30] Foreign Application Priority Data

Jun. 28, 1991 [DE] Germany ..... 41 21 540.0

[51] Int. Cl.[6] ..... B65D 25/08

[52] U.S. Cl. ..... 206/221; 206/219; 215/6; 215/DIG. 8; 220/521

[58] Field of Search ..... 220/521, 522, 220/212; 215/354, 356, 364, DIG. 8, DIG. 7, 6; 206/219, 220, 221, 568

[56] References Cited

U.S. PATENT DOCUMENTS

| | | | |
|---|---|---|---|
| 2,385,648 | 9/1945 | Prager | 206/221 |
| 2,629,508 | 2/1953 | Prager | 220/521 X |
| 3,079,022 | 2/1963 | Tompkins | 220/521 X |
| 3,199,704 | 8/1965 | Davidson | 215/354 X |
| 3,924,741 | 12/1975 | Kachur et al. | 206/221 |
| 4,203,517 | 5/1980 | Hildebrandt et al. | 206/221 |
| 4,776,972 | 10/1988 | Barrett | 215/DIG. 8 X |
| 4,793,475 | 12/1988 | Itzel | 206/221 |
| 4,800,156 | 1/1989 | Yuhda | 215/354 X |
| 4,903,828 | 2/1990 | Finke et al. | 206/221 |

FOREIGN PATENT DOCUMENTS

| | | |
|---|---|---|
| 0190593 | 8/1986 | European Pat. Off. . |
| 0235806 | 9/1987 | European Pat. Off. . |
| 2370650 | 6/1978 | France . |
| 2544328 | 4/1976 | Germany . |
| 2625175 | 12/1977 | Germany . |
| 8502008 | 10/1985 | Germany . |

*Primary Examiner*—Allan N. Shoap
*Assistant Examiner*—Stephen Cronin
*Attorney, Agent, or Firm*—Martin A. Farber

[57] ABSTRACT

A bottle closure cap for two-component packings having a collar which extends into the bottleneck and bears a beaker via a thread of opposite direction to the bottle screw-on thread. For ease in manufacture and use, the invention proposes that the collar (9) which extends into the bottleneck continue on top in a collar wall (11) with internal thread (14) in order to receive and hold a lid (28).

6 Claims, 8 Drawing Sheets

BOTTLE CLOSURE CAP FOR TWO-COMPONENT PACKINGS

RELATED APPLICATION

This application is a continuation of our application Ser. No. 07/922,529 filed: Jul. 29, 1992 now abandoned which in turn is a continuation of the now abandoned application Ser. No. 07/906,303 filed: Jun. 29, 1992 now abandoned.

FIELD AND BACKGROUND OF THE INVENTION

The present invention relates to a bottle closure cap for two-component packings with a collar which extends into the bottleneck and, via a thread which is of opposite direction to the bottle screw-on thread, bears a beaker.

A bottle closure cap of this type is known from Federal Republic of Germany Utility Model 85 02 008, in which the collar, which extends from the cap lid and is provided with the thread for the beaker, is cylindrical over its entire length. The reception space created in this manner for a first component is relatively small as compared with the commercial bottles, which contain the second component. Enlargement of the volume of the bottle closure cap could be obtained by making the collar correspondingly longer and of larger diameter. This would also result in a change in the bottleneck.

SUMMARY OF THE INVENTION

The object of the present invention is to develop a bottle closure cap of the type in question in such a manner, while favorable in manufacture and use, that a large volume of the bottle closure cap is obtained without, insofar as possible, any structural change in the bottle.

According to the invention the collar (9) which extends into the bottleneck continues on the top into a collar wall (11) with internal thread (40) in order to receive and hold a lid (28).

In accordance with the invention, a bottle closure cap for two-component packings is indicated which has a collar which extends into the neck of the bottle and bears a beaker via a thread which extends in opposite direction to the bottle screw-on thread. The collar, which extends into the neck of the bottle, is continued at its top into a collar wall having an internal thread. In this way, a lid or some other closure part can be received inside on top by screwing-in. Preferably, or as an alternative to this, it is also provided that a collar wall of smaller diameter or an outwardly directed zone pass into a cylindrical collar wall of larger diameter in such a manner as to result in a Z-shape profile in cross section and that the region of the wall of larger diameter can be closed in liquid-tight manner by a lid. The Z-shape corresponds in this connection to a somewhat stretched Z in connection with which the region of connection is preferably inclined forward instead of rearward as in the case of the letter. In this connection, it is furthermore preferably provided that the wall of the collar of larger diameter be developed with said internal thread or form-locking means in order to receive and hold the lid, or, expressed more generally, a covering for the reception space. In principle, this covering of the reception space can also be held in force-locked manner, for instance, pressed therein. The upper wall of the collar or the collar wall of larger diameter has furthermore in this connection preferably only internal form-locking means. This collar wall of larger diameter can therefore simply be smooth for instance on the outside. In addition to the said thread, the form-locking means can also have, for instance, detent projections which cooperate with each other. In this connection, the form-locking means preferably consist in part of a thread and in part of a detent connection, the thread being developed on a stepped-down surface of smaller diameter in the lower region of the cap body, while associated with the upper edge, substantially vertically extending detent projections are provided.

The lid or the receiving-space covering can in this embodiment also preferably be developed as a bottle-like structural part. The neck of this (upper) bottle is then screwed into the collar wall of larger diameter with the inner form-locking means or internal thread. The aforementioned (additional) detent means of preferred development prevent, after the receiving-space covering or bottle-like structural part has once been screwed in, said structural part from being detached separately upon the unscrewing of the cap. Due, in particular, to said bottle-like development of the cap, it is possible so to develop the receiving-space covering that the diameter of this covering or of the cap exceeds the diameter of the collar wall of larger diameter. The total volume to be stored in the bottle closure cap can in this way be considerably enlarged, in accordance with the different purposes of use—this, in its turn, without it being necessary to change the structural development of the corresponding bottleneck (on which the bottle closure cap as a whole is to be placed). Commercial bottles can therefore be provided with such a bottle closure cap. In general, it may furthermore be said, in order to facilitate understanding, that for the sealing of the bottle-closure cap volume there serves, on the one hand, the beaker which is screwed onto the collar wall of smaller diameter or the lower collar wall and, on the other hand, the lid or closing receiving-space covering which serves to close the wall region of larger diameter or upper wall region. By the closable space on both ends of the bottle closure cap, advantages then result in manufacture, namely with respect to the control of the cores of the injection mold creating the inward and outward control of the detailed spaces. Furthermore, it is now possible to fill the bottle closure cap in two different ways.

Furthermore, it is now possible to fill the bottle closure cap in two different ways. On the one hand, the lid can already be placed on the region of the wall of larger cross section. Upon the filling, the lid serves as standing surface, so that the beaker is to be screwed into the closure position after the filling. It is then possible, first, to screw-on the beaker and then to fill the bottle closure cap. The lid is then attached in fluid-tight manner.

One advantageous further development also consists therein that a downward extending neck collar which has the bottle screw thread on the inside is integral with the wall region of larger diameter. On the one hand, in this way the collar which extends in Z-shape in cross section is imparted additional stabilization. On the other hand, due to the collar wall of smaller diameter and the neck collar lying concentric thereto, the entrance space for the beaker wall and the bottleneck is created, as a result of which the bottle closure cap is imparted further stabilization in its screwed-on position so that even larger transversely directed blows can be absorbed without damage.

In order to be able to fasten the lid easily and in stable manner, the lid extends over the cylindrical collar wall of larger diameter, can be screwed onto the latter, and can be fastened, secured against rotation, in screwed-on condition. In this way, the lid is prevented from unintentionally coming out of the position in which it seals off the space of the bottle closure cap. Together with a possible untwisting of the lid, the entire bottle closure cap is turned together with the beaker at the same time. Turning in the other direction has the result that, due to its oppositely directed thread, the beaker, as is already known, is unscrewed so that the cap-side component in the bottle closure then comes into the bottle space and mixes there with the other component.

The anti-twist lock is developed in a manner easy to manufacture, as a tooth engagement and lies at the height of the transition zone and therefore in a stable region of the bottle-closure cap.

The anti-twist lock can also be produced in the manner that the collar wall of larger diameter is provided with inner radial detent projections which cooperate with the downward extending drive arms extending from the inside of the lid. Such a development is also of independent importance within the scope of the invention. In addition to stabilization of the collar wall of larger diameter, the radial detent projections, together with the driver arms, lead to an internesting of lid and collar wall of larger diameter. The development of the detent projections and detent arms is such that they form an anti-twist lock which acts in the unscrewing direction. The inner space of the closure cap can therefore never be unintentionally opened.

The lid fulfills a two-fold purpose in the manner that it continues downward over the wall region of larger diameter and is provided with an internal thread for screwing onto the bottleneck.

A further simplification in manufacture results from the fact that a collar wall of larger diameter is aligned with the bottleneck. The lid wall can accordingly be provided with a continuous bottle screw-on thread, the portion of the lid edge which is concentric to the collar wall of smaller diameter forming the neck collar.

Finally, an advantageous feature also consists of the fact that the end of the collar wall of larger diameter extends in form-locked and sealing manner into an annular groove on the inside of the lid. In this way, the lid-side seal is optimal. With the screwing of the lid onto the thread of the collar wall of larger diameter, the seal between lid and corresponding collar wall is at the same time achieved in the final phase.

BRIEF DESCRIPTION OF THE DRAWINGS

Three embodiments of the invention will be explained below with reference to FIGS. 1 to 13 of the drawing, in which.

DETAILED DESCRIPTION OF THE PREFERRED EMBODIMENTS

Figure 1:
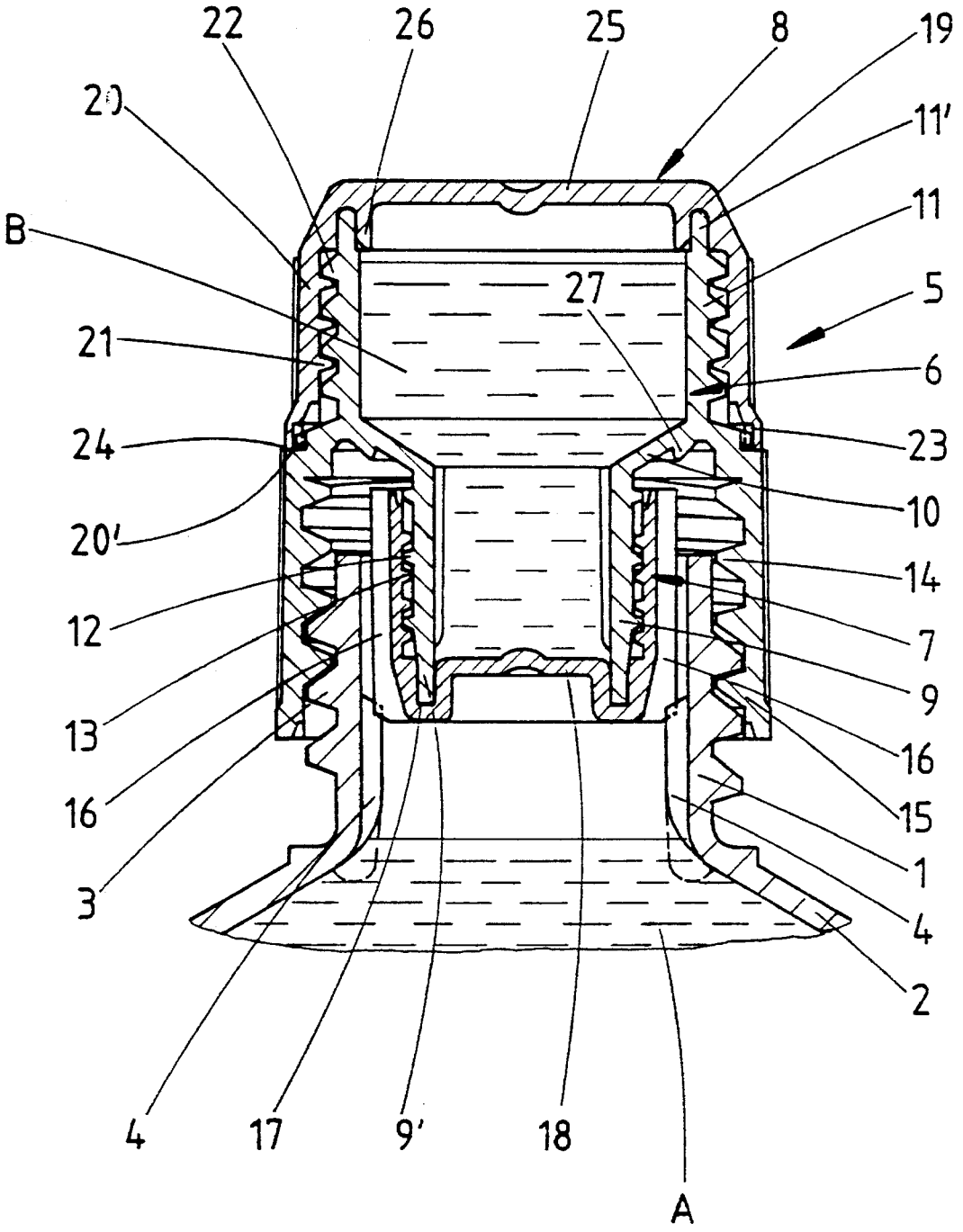
FIG. 1 is a longitudinal section through a bottle closure cap, placed on the bottle, as well as of a bottle closure cap in accordance with a second embodiment.

FIG. 1 shows and describes a bottle closure cap, shown as a whole, in FIG. 1, which has an upper lid 8 and a lower beaker 7. The bottle closure cap is shown in FIG. 1 in position screwed onto a bottleneck of a bottle 2. The embodiment in accordance with FIG. 1 will be discussed in further detail below.

Figure 2:
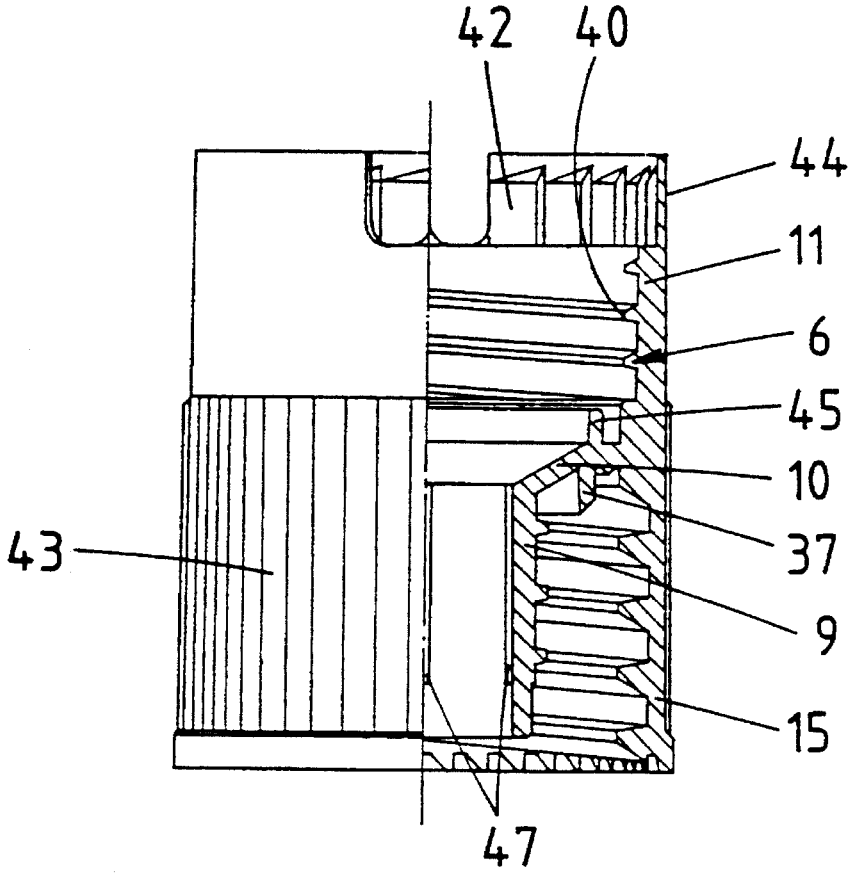
FIG. 2 is a view partially in elevation and partially in section of a closure cap body without lower beaker and upper lid or covering.

In FIG. 2, the core part of the bottle closure cap is shown by itself. The collar 6 is divided into a collar wall 9 of smaller diameter which passes, via an outwardly directed frustoconically extending transition zone 10, into a cylindrical collar wall 11 of larger diameter. Referred solely to the development of collar wall 11, transition zone 10 and collar wall 9 of smaller diameter, a cross-sectional profile is created of, as a whole, a Z-like shape, the connecting arm of the Z being displaced obliquely forward as compared with the shape of the letter. The collar wall 11 of larger diameter is provided on the inside with a thread 40 by means of which a receiving-space covering 41—see for instance, FIG. 6—can be connected to the collar 6. In the upper region of the collar wall 11 of larger diameter, approximately triangularly shaped overrun projections, as seen in cross section, are developed which, with the receiving-space covering 41 screwed on, prevent the receiving-space covering 41 from being screwed off again upon the turning of the closure cap.

The cylindrical collar wall 11 of larger diameter is provided with the said form-locking means merely on the inside. On the outside, it is smooth in the embodiment shown in FIG. 2. In the lower region, in which the lower neck collar 15 grips over the bottleneck, a ribbing 43 is, however, provided for ease in handling.

As can be seen, the overrun projections 42 extend substantially vertically in the uppermost edge region of the collar wall 11, the edge region 44, which is again reduced in cross section as compared with the collar wall 11 but is developed aligned on the outside with it. In addition, they have an upper obliquely extending triangular surface.

With respect to the arm 37, reference is had to the description given further below.

Another sealing collar 45 is arranged on the top of the transition zone 10. Approximately in axial extension, although slightly shifted outward, to the lower sealing collar 37.

Furthermore, it is clear that in the embodiment in accordance with FIG. 2, the transition region 10 initially extends obliquely and then passes into a substantially horizontal path. The wall of the connecting region between the upper cylindrical collar wall 11 and the lower neck collar 15 is thickened.

Figure 6:
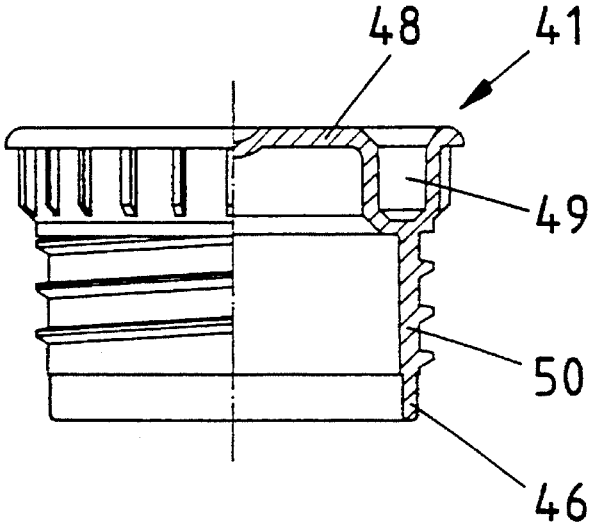
FIG. 6 is a view in elevation, partially in section, of a closure-lid with external thread.

The upper sealing collar 45 serves to form a groove for the inclusion of the sealing lip 46 on the lid in accordance with FIG. 6.

Figure 3:
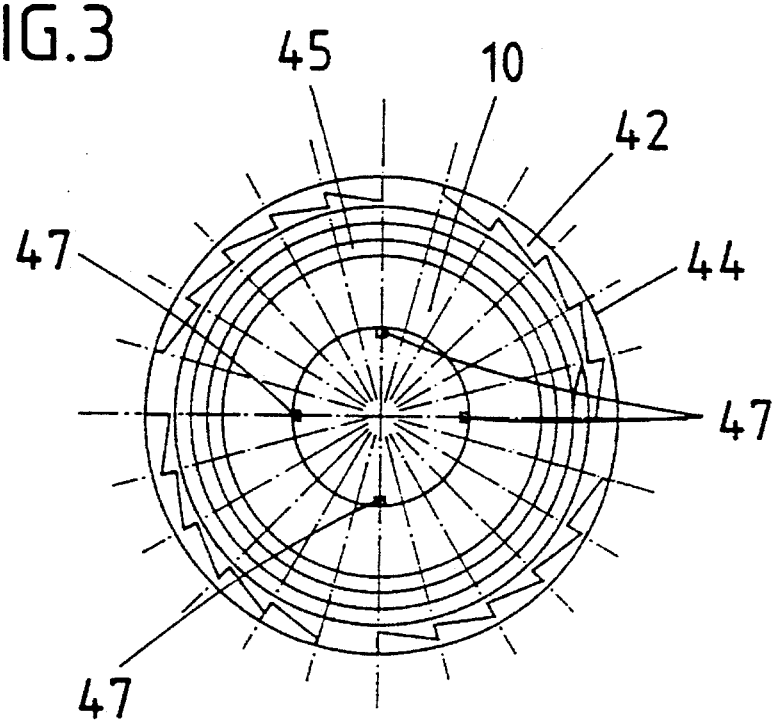
FIG. 3 is a top view of FIG. 2.

FIG. 3 is a top view of FIG. 2. The triangular shape of the overrun projections 42 can, in particular, be noted.

In particular also for forming reasons, vertically extending ribs 47 are developed on the inside of the cylindrical wall of the beaker 7, namely, four ribs 47 distributed over the circumference.

Furthermore, for a general description reference is had to what is stated further below with respect to the additional embodiment.

Figure 4:
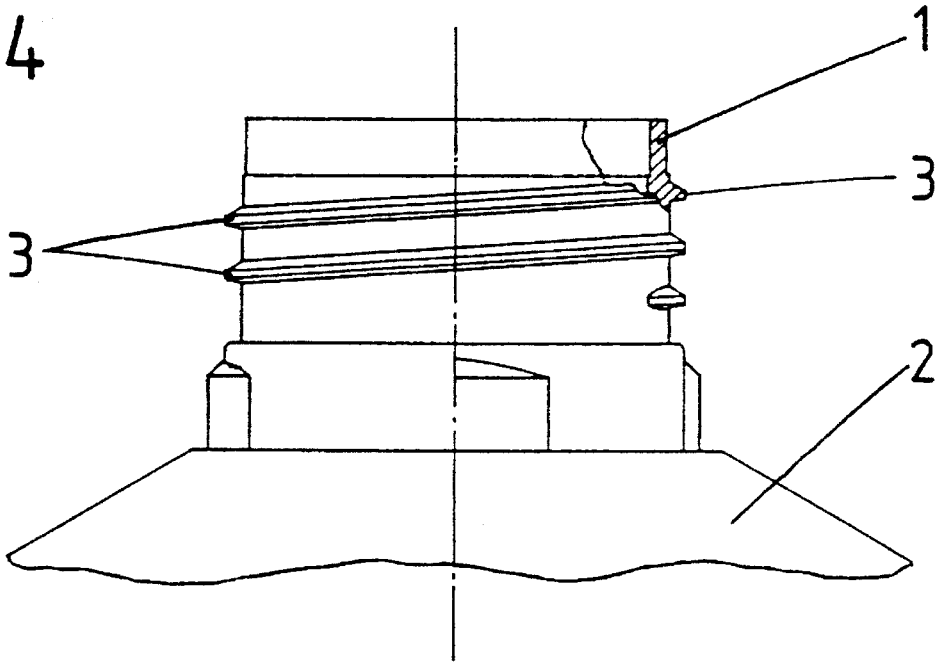
FIG. 4 is a view in elevation of a corresponding bottleneck, partially in section.
Figure 5:
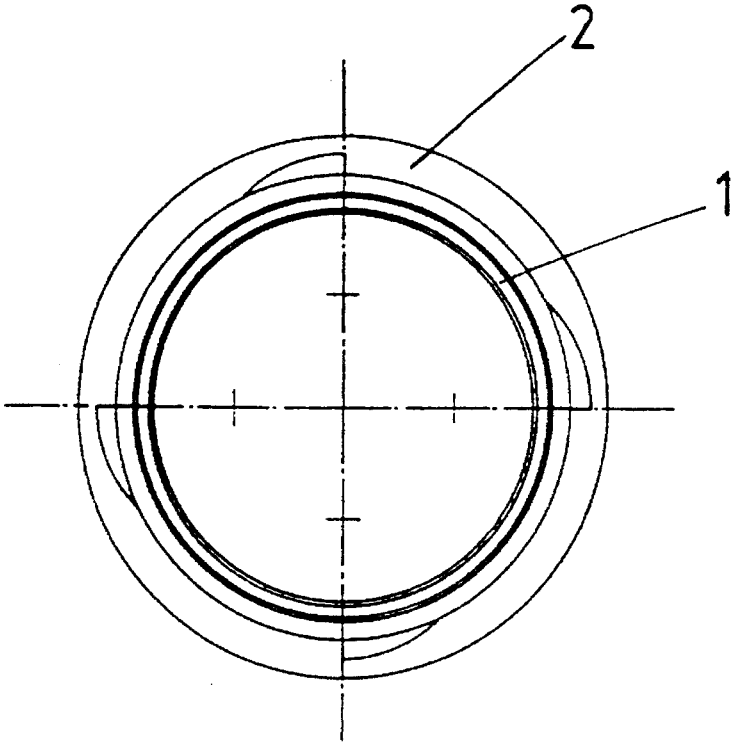
FIG. 5 is a top view of FIG. 4.
Figure 7:
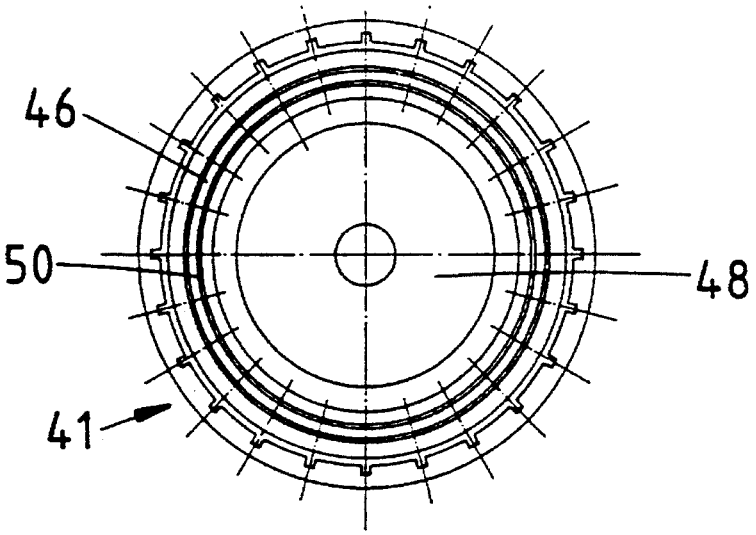
FIG. 7 is a bottom view of FIG. 6.
Figure 8:
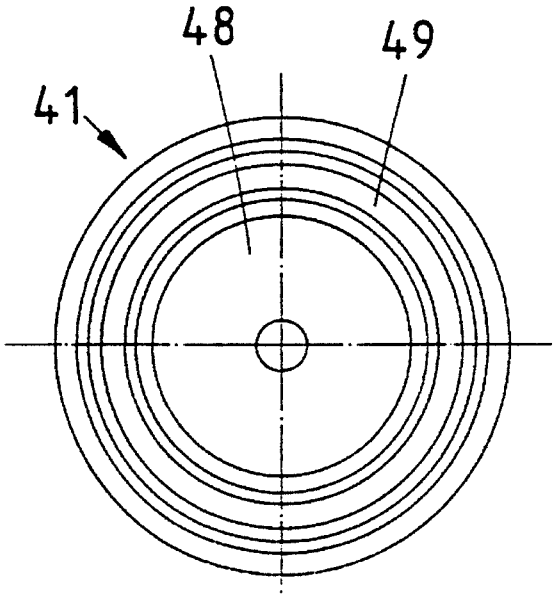
FIG. 8 is a top view of FIG. 6.

FIGS. 4 and 5 are an individual view of a bottleneck on which such a closure cap, particularly in the embodiment previously described, can for instance be applied. FIGS. 6 to 8 show a lid such as is suitable in particular for the embodiment according to FIGS. 2 and 3.

The lid has a cap surface 48 which is developed on its edge in the form of a circumferential groove 49. Adjoining the bottom there is a screw collar 50 which is developed as a whole in Y-shape with the cap surface 48 with respect to said groove 49. On the outside, the screw collar 50 has an external thread which fits the inner thread 40 of the embodiment of FIGS. 2 and 3.

Below the screw collar 50 there is a sealing lip 46, which has already been mentioned above from the showing in accordance with FIG. 6, as well as from the bottom view in accordance with FIG. 7.

FIG. 8 is a top view of FIG. 6. In particular, the dimensional relations of said groove 49 and the further development of the cap surface 48 can be noted.

Figure 9:
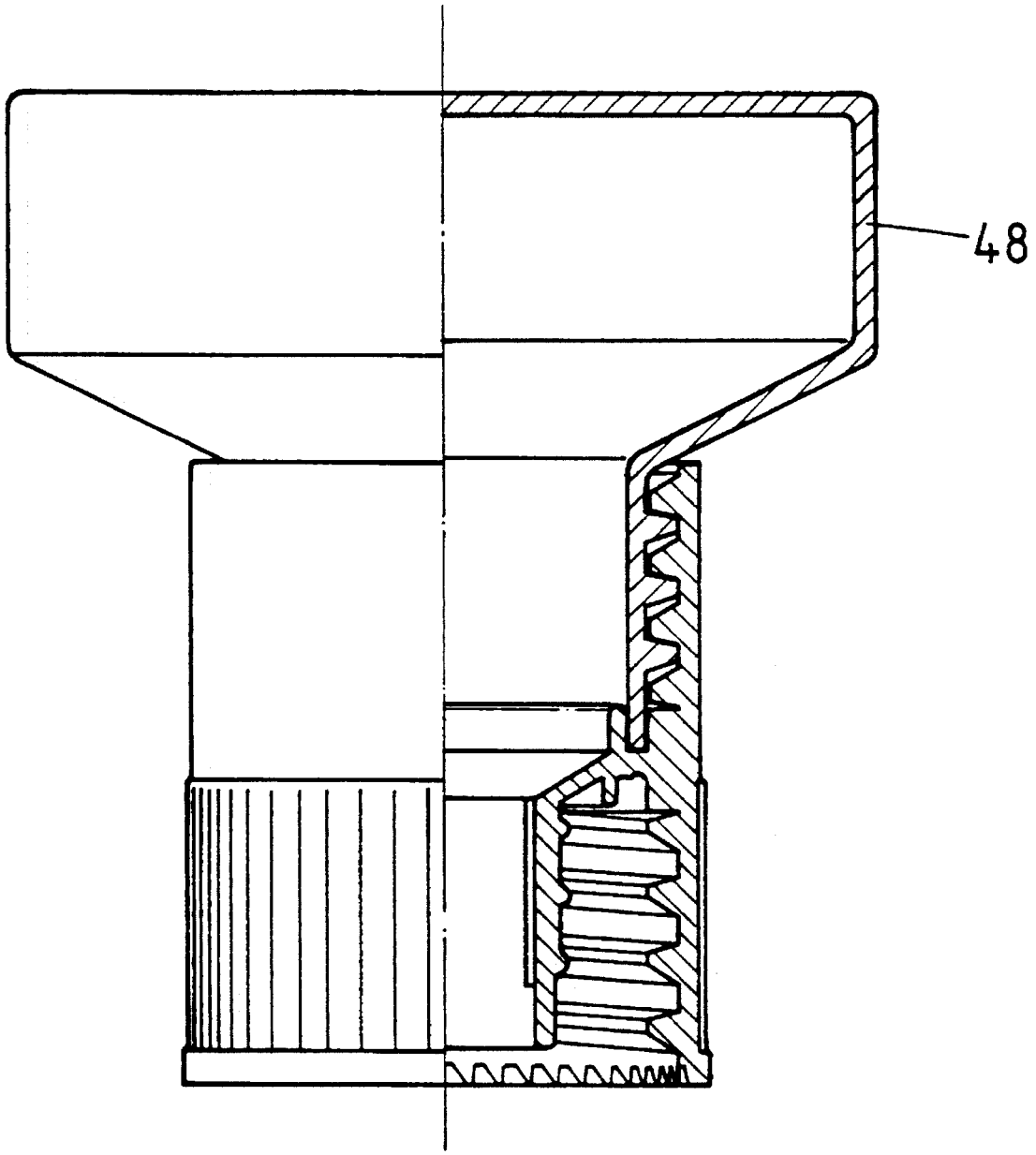
FIG. 9 is a cross section through a cover cap with bottle-like development of the receiving-space covering bottleneck of a second embodiment.
Figure 10:
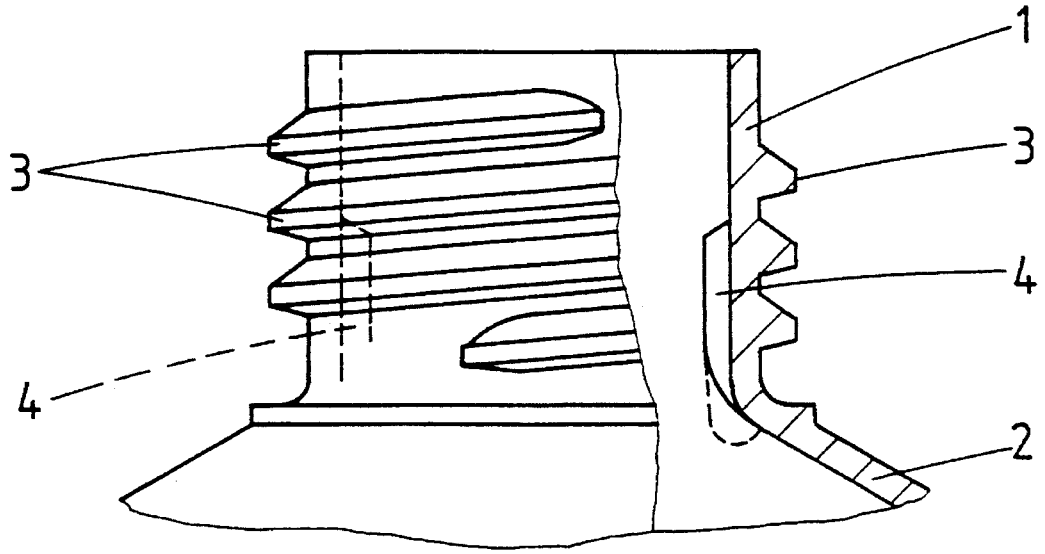
FIG. 10 shows a bottleneck of a second embodiment, partially in elevation and partially in section.
Figure 11:
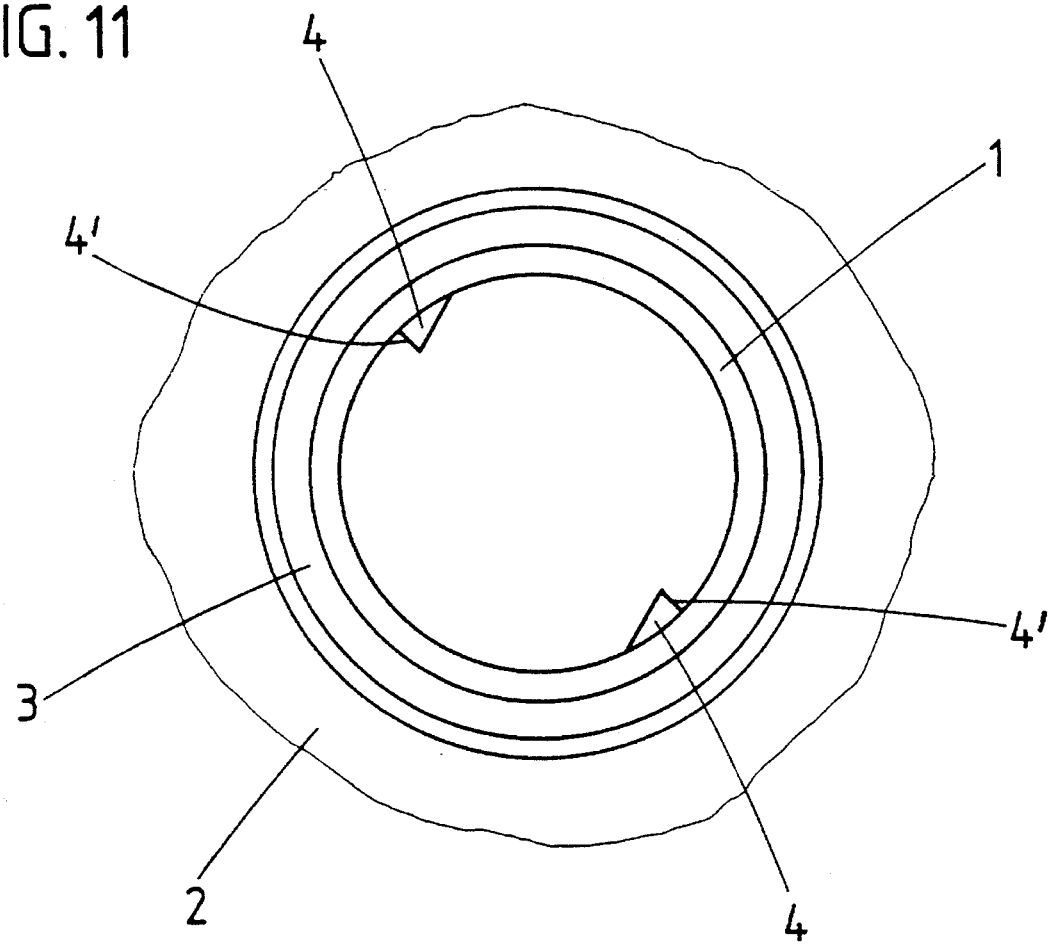
FIG. 11 is a top view of FIG. 10.
Figure 12:
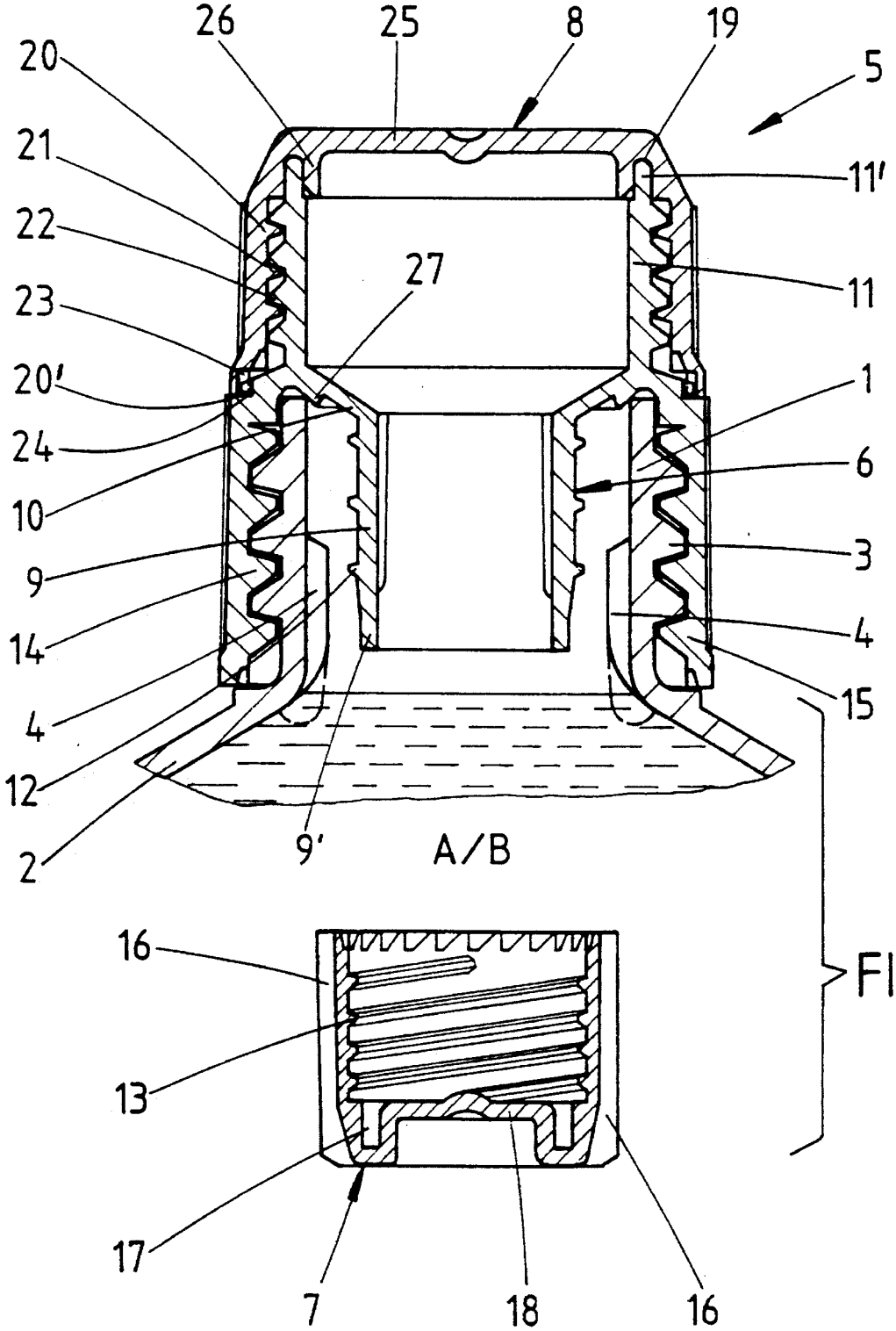
FIG. 12 is a view corresponding to FIG. 1 after completion of the screwing-on movement and with the beaker unscrewed.
Figure 13:
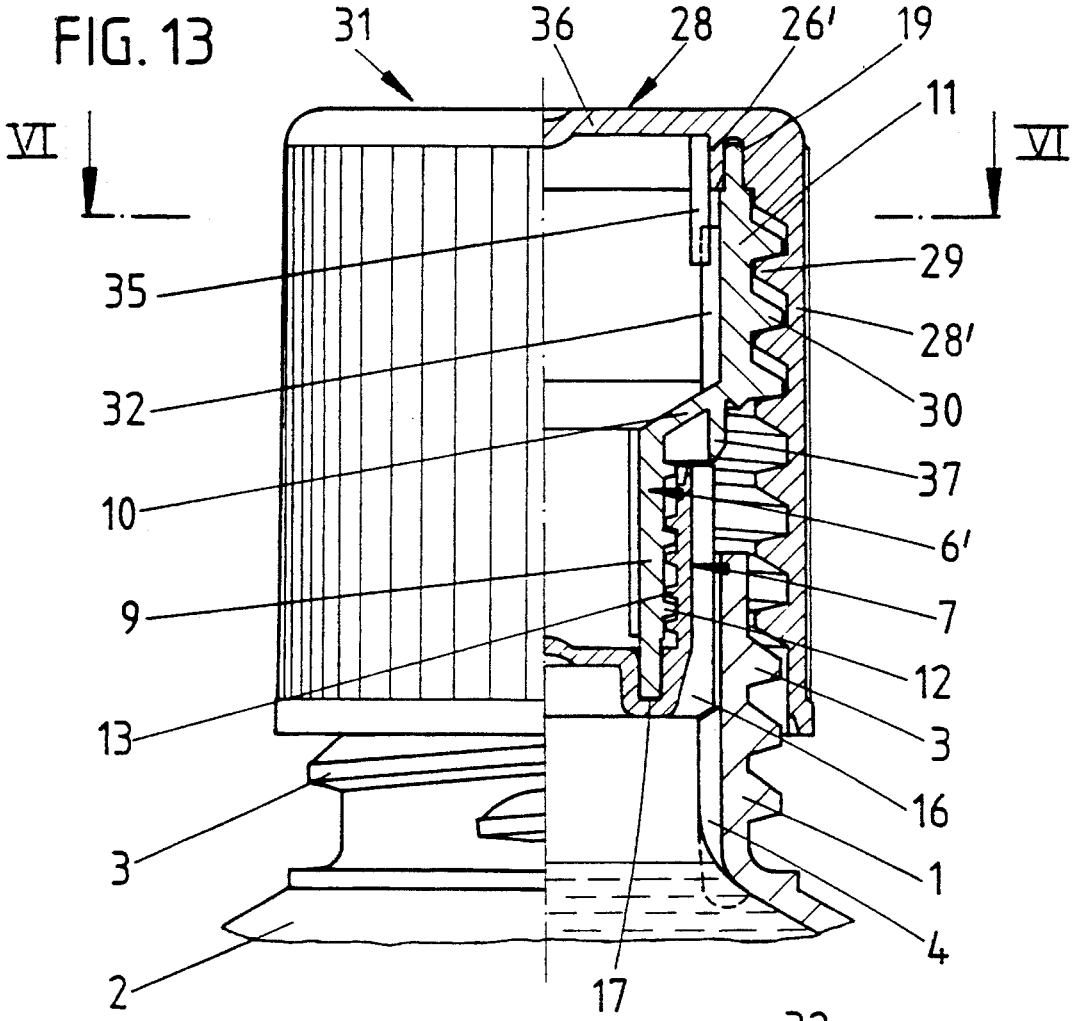
FIG. 13 shows, partially in elevation and partially in longitudinal center section, the bottle closure cap of the second embodiment, in partially screwed-on position.
Figure 14:
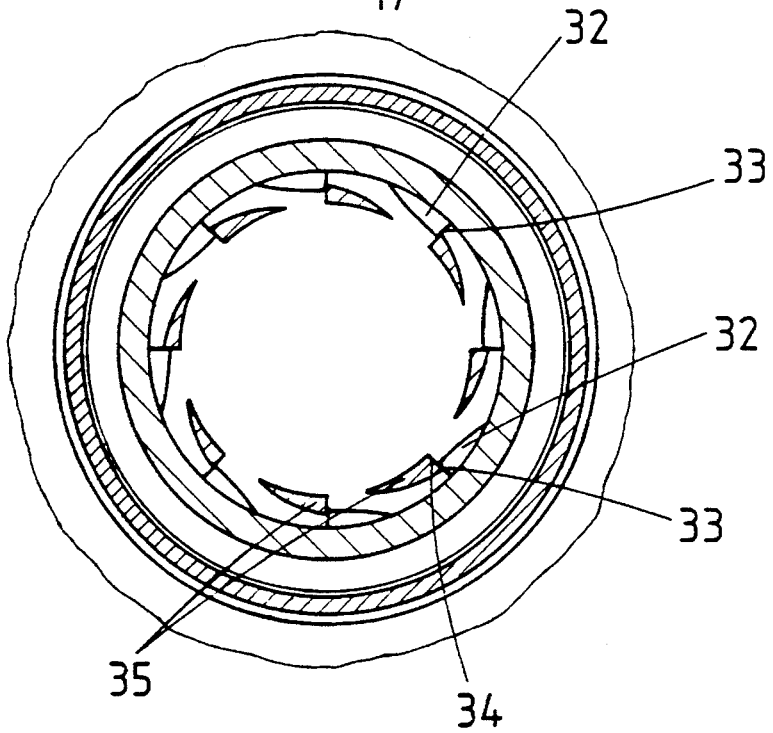
FIG. 14 is a section along the line XIV—XIV of FIG. 13.

In FIG. 9, a further variant of the embodiment described above is shown. In this case, the covering or lid 48 is developed in the form of a bottle. An even larger receiving space results. In this case also, it is seen to it that unintentional unscrewing of the receiving-space cover is not possible. The lid 48, developed as a bottle, can therefore also be a glass part.

A further embodiment will be described with reference to FIGS. 1 and 10 to 14.

In this case also, the closure cap 5 serves to receive another component B, for instance in the form of a concentrate, such as a plant protection agent, a beverage syrup, or the like. A collar 6 which extends into the neck of the bottle, a beaker 7 and a lid 8 serve to form the receiving space for this component.

The bottleneck 1 extends, stepped down, from a bottle 2, shown in part in the figures. The bottle serves to receive a liquid component A. The bottleneck 1 is provided with a saw-tooth thread 3 on the outside, its lower flank being steeper than its upper flank.

From the inner wall of the bottleneck 1, there extend two diametrically opposite integrally developed ledges 4 which are located approximately at the center of the bottleneck 1 and extend into the transition region between bottleneck and bottle. The cross sectional shape of the ledges 4 can be noted from FIG. 12. It can be noted therein that the ledges 4 are approximately triangular in cross section in such a manner that the shorter triangle sides 4' lie in the radials and form stop shoulders.

The collar 6 of the bottle closure cap has a collar wall 9 of smaller diameter.

The collar 6 has a collar wall 9 of smaller diameter which passes, via an outwardly directed frustoconically extending transition zone 10 into a cylindrical collar wall 11 of larger diameter in such a manner that a Z-shaped cross section results. On its outer side, the collar wall 9 of smaller diameter is provided with a thread 12 which cooperates with a corresponding mating thread 13 on the inner wall of the beaker 7. The thread is a two-start left-handed thread which is developed in opposite direction to the bottle screw-on thread 14 of the bottle closure cap 5. The bottle screw-on thread 14 is located in this connection on a neck collar 15 which lies concentrically to the collar wall 9 of smaller diameter and extends integrally from the wall region 11 of larger diameter. The neck collar 15, on its part, however, is larger than the collar wall 11 of larger diameter.

The corresponding opposite direction of the threads is used in order to achieve an unscrewing of the beaker 7 from the collar wall 9 of smaller diameter upon the screwing-on of the closure cap 5. For this purpose, anti-twist means are inserted between the bottleneck 1 and the beaker 7. On the beaker side, these are two axially directed diametrically opposite projections 16 which cooperate with the aforementioned ledges 4 of the bottleneck 1. The coupling engagement which holds the beaker 7 fast takes place only after a screwing-on movement of about 360° and therefore, in a phase in which the threaded engagement between neck collar 13 and bottleneck is present. Since the ledges 13 are seated only at half the height of the bottleneck, the region in front thereof on the mouth side does not act to prevent turning. After passing over the ends of the projection 16 directed towards each other and the ledges 4, the coupling engagement results due to the thread.

In order to obtain the lower seal, the free end 9' of the collar wall of smaller diameter engages into an annular groove 17 in the beaker 7. The annular groove 17 is formed by a central inward cupping of the beaker bottom 18. In this way, the region of the edge of the beaker bottom, as seen in cross section, is of U-shape. As shown in the corresponding figures, the end 9' is reduced in thickness by at least the amount of the groove depth, namely by removal of the collar 7 on the wall side.

The wall-reduced end 11' of the collar wall 11 of larger diameter engages in form-locked and sealing manner into an annular groove 19 on the inner side of the lid. A cylindrically extending lid wall 20 of the lid 8 extends over the cylindrical collar wall 11 of larger diameter. The lid wall 20 forms an internal thread 21 which cooperates with an external thread 22 of the collar wall 11 of larger diameter. In the screwed-on state of the lid 20, an anti-twist lock is present between lid 8 and collar 6. This anti-twist lock is developed in the form of a tooth engagement 23 which is located at the height of the transition zone 10. This anti-twist device is an elastic anti-twist toothing, so that upon the unscrewing of the bottle closure cap 5 the collar 6 is carried along. The screwing-on movement is limited at the height of the transition zone in the manner that the end edge 20' of the lid wall comes against a circumferential transverse step 24 of the neck collar 15.

The aforementioned annular groove 19 is formed in the manner that an annular collar 26 extends integrally from the lid plate 20 and passes concentrically to the axis of the closure cap. In this way, the lid plate 25 can be made relatively thin, increasing the storage space for the component B.

For the introduction of the concentrate forming the component B, the bottle closure cap 5 can be placed on the lid plate 25 so that the collar wall 9 of smaller diameter has its opening facing upward. The filling is then effected, whereupon the beaker is screwed on from above in cap-like manner over a feed device. The other possibility for filling consists in the beaker being previously screwed on in liquid-tight manner. The lid then still does not close the receiving space of the closure cap. After the filling of the receiving space with component B the lid is placed on by screwing.

If mixing of the two components A and B is to take place, the bottle closure cap 5 is screwed on further beyond the position of turning of FIG. 1, in which connection the projections 16 arranged on the beaker wall pass into non-turning but axially displaceable coupling engagement with the bottleneck-side ledges 4. In this connection, due to the opposite direction of the threads, the beaker 7 is unscrewed and drops into the inside of the bottle. With the complete screwing on of the bottle closure cap 5, the latter itself has then come into sealing enclosure engagement with the bottleneck 1, in the manner that a sealing collar 27 developed on the transition zone 10 enters into the mouth of the bottleneck 1 and presses there against the elastic inner edge; see FIG. 4.

A pouring out of the mixed liquid can take place, for instance, in the manner that the bottle closure cap is unscrewed and releases the bottleneck. However, a second bottleneck and a second closure cap which is not provided with a beaker can also be associated with the bottle 2. Before the mixing of components A and B, the bottle closure cap 5 is on this second bottle neck, while the bottleneck 1 is sealed in liquid-tight manner by the other closure cap. A mixing of the components then merely requires interchanging the two bottle closure caps. For the user therefore, the instruction to change the caps is sufficient in order to bring about the mixing.

In the second embodiment, shown in FIGS. 5 and 6, the same structural parts bear the same reference numbers. Differing from the first embodiment, the collar 6' does not have the integrally developed neck collar. The latter is replaced in the manner that the lid 28 continues downward over the wall region 11 of larger diameter and is provided on the inside with a continuous internal thread 29 for screwing onto the bottleneck 1. This means that the external thread 30 of the wall 11 of larger diameter of the collar 6' corresponds to the saw-tooth thread 3 of the bottleneck 1. Furthermore, in the screwed-on state of this modified closure cap 31, the collar wall 11 and the bottleneck 3 are aligned with each other.

The anti-twist lock in this second embodiment is obtained by different means. For this purpose, the collar wall 11 of larger diameter is equipped with inner radial detent projections 32, arranged with the same circumferential distribution. They have an approximately triangular cross section with stop shoulders 33 lying in the radials. The latter cooperate with mating shoulders 34 of driver arms 35 which extend, on the inside, from the lid plate 36. On the first part of their length, they are developed integrally with an annular collar 26' on the inner side of the lid, while the remaining part extends freely into the inside of the collar. FIG. 15 shows that the driver arms also have a triangular cross section, the two longer sides of the triangle extending in arcuate shape. By this measure, the result is obtained that while the lid can be screwed onto the collar wall 11 of the collar 6, the driver arms moving away inward, upon the unscrewing of the lid the shoulders 33, 34, come against each other and result in the carrying along of the collar 6'.

In this embodiment also, a sealing collar 37 is provided on the transition zone 10, the collar engaging in sealing manner into the bottleneck 1 when the bottle closure cap 31 is completely screwed on and the beaker 7 unscrewed.

The two embodiments have the feature in common that by the very close internesting of the structural parts forming the bottle closure cap they have, with small dimensions, a large volume for receiving the component B.

We claim:

1. A bottle closure cap for a two-component packing containing a first component and a second component, wherein the two-component packing comprises a bottle for receiving the first component and the closure cap for receiving the second component, the bottle having a neck and screw-on thread threaded in a first direction for receiving the closure cap, the closure cap having a screw-on thread threaded in said first direction for attachment to the screw-on thread of the bottle, the closure cap comprising:

a collar having an inner portion which extends into the neck of the bottle upon attachment of the cap to the screw-on thread of the bottle, the cap screw-on thread being located on said collar;

a cover to be received by a first end of said collar distant from said inner portion of said collar, and a beaker supported by said inner portion of the collar for receiving the second component, the beaker connecting with the collar via a thread which is threaded in a second direction opposite to said first direction of the bottle screw-on thread, the beaker being located within the bottle upon attachment of the cap to the bottle;

wherein said inner portion of the collar has a wall of reduced diameter for extending into the bottle neck, the collar including a transition zone and a cylindrical wall of larger diameter, said cylindrical wall of larger diameter extending between said transition zone and said first end of said collar;

the reduced-diameter wall passes outwardly via the transition zone into the cylindrical collar wall of larger diameter, the collar with its reduced-diameter wall and its larger-diameter wall defining a receiving space for storing of the second component;

the receiving space is closable on said first end of said collar opposite the beaker by the cover, the cover being disposed on the larger-diameter wall of the collar; and said collar wall of larger diameter has form-locking means for inhibiting an unscrewing of said cover from said collar.

2. A bottle closure cap according to claim 1, wherein said form-locking means of the collar wall of larger diameter is only an inside form-locking means for receiving and holding the cover.

3. A bottle closure cap according to claim 1, wherein the cover is developed as a bottle-like structural part.

4. A bottle closure cap according to claim 3, wherein the collar further comprises a skirt having said cap screw-on thread and which extends, upon attachment of the cap to the bottle, outwardly of the bottle neck to receive the bottle screw-on thread on its inner side, the collar skirt being developed integral with the wall region of the larger diameter.

5. A bottle closure cap according to claim 1, wherein the cover has a diameter which exceeds the diameter of the collar wall of larger diameter.

6. A bottle closure cap according to claim 1, wherein the collar further comprises a skirt having said cap screw-on thread and which extends, upon attachment of the cap to the bottle, outwardly of the bottle neck to receive the bottle screw-on thread on the inside of the collar skirt, the collar skirt being developed integral with the collar wall of larger diameter.

* * * * *